United States Patent [19]

McDermott

[11] Patent Number: 4,625,968

[45] Date of Patent: Dec. 2, 1986

[54] TRAPPED BALL AMUSEMENT DEVICE

[76] Inventor: Brian L. McDermott, 120 Pickford, Walled Lake, Mich. 48088

[21] Appl. No.: 682,846

[22] Filed: Dec. 18, 1984

[51] Int. Cl.[4] ..... A63F 9/08

[52] U.S. Cl. ..... 273/156; 206/1.5

[58] Field of Search ..... 273/156; 206/1.5

[56] References Cited

U.S. PATENT DOCUMENTS

| | | | |
|---|---|---|---|
| 474,941 | 5/1892 | Bartholomew | 206/1.5 |
| 1,733,772 | 10/1929 | Battershell | 206/1.5 |
| 2,181,116 | 11/1939 | Boyle | 273/156 |
| 2,207,778 | 7/1940 | Boyle | 273/156 |
| 3,684,292 | 8/1972 | Penrod et al. | 273/156 |
| 3,695,617 | 10/1972 | Mogilner et al. | 273/156 |

*Primary Examiner*—Anton O. Oechsle

*Attorney, Agent, or Firm*—Charles W. Chandler

[57] ABSTRACT

An amusement device is disclosed comprising a cage having a base, a cap and four corner pins enclosing a ball. One of the corner pins is removable to release the ball from the cage.

7 Claims, 4 Drawing Figures

TRAPPED BALL AMUSEMENT DEVICE

BACKGROUND OF THE INVENTION

This invention is related to an amusement device of the type in which a ball is trapped within a cage and more particularly to such a device in which the cage comprises four pins, one of which is removable when the cage is struck in a particular manner.

SUMMARY OF THE INVENTION

The broad purpose of the present invention is to provide an amusement device or puzzle comprising a cage formed of a cap, a base and four corner pins which enclose a ball. Each pin has its ends received in sockets in the cap and the base. All four pins are similar and appear to be similarly connected to the cap and the base. The socket in the cap receiving one of the pins has a latch preventing the pin from being moved into the socket a sufficient distance for the other end of the pin to clear the socket in the base. The latch is mounted in an opening adjacent the socket. A magnet is mounted in a second opening adjacent the latch. The magnet engages the latch to prevent the pin from being fully inserted in the socket. The magnet is released from the latch by rapping the cage in one direction. The latch is then moved out of the socket by a second rap in another direction. The pin can then be inserted further in the socket so that its opposite end is removed from the socket in the base to release the pin from both the cap and base.

Each of the pins is rotatable in its respective sockets so that it is difficult for the uninformed observer to detect how any of the pins can be removed. Thus the preferred embodiment of the invention provides a novel puzzle for those interested in such amusement devices.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
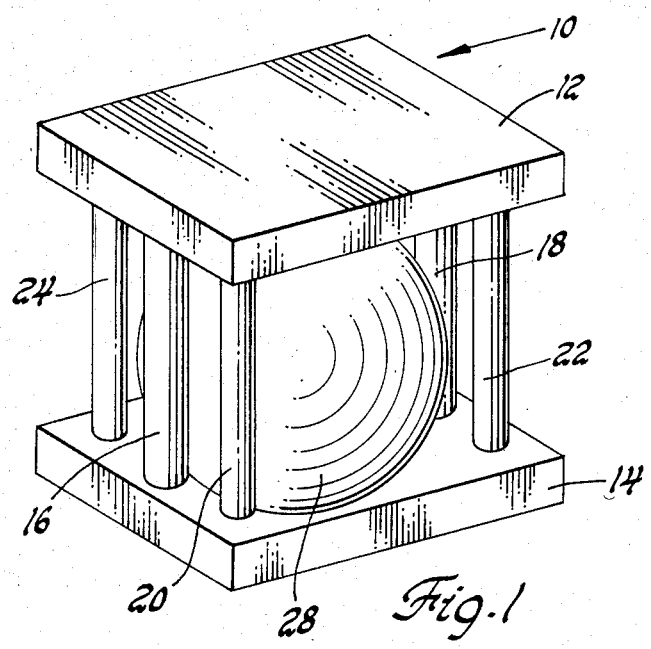
FIG. 1 is a perspective view illustrating the preferred amusement device.

Referring to the drawing, FIG. 1 illustrates a preferred amusement device 10 comprising a plate-like cap 12 and a plate-like base 14. Both the cap and the base are formed of a non-magnetic material such as aluminum, or brass.

Figure 2:
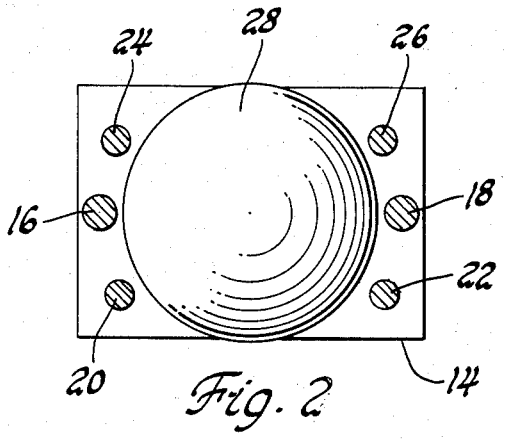
FIG. 2 is a plan, sectional view of the device showing the cap removed.

Referring to FIG. 2, a pair of steel bars 16 and 18 are mounted between the cap and the base. The upper ends of the two bars are firmly attached to the cap and their lower ends are attached to the base so that the cap and base cannot be moved with respect to one another.

Brass pins 20, 22, 24 and 26 are also mounted between the cap and the base. Each end of each pin is mounted in a socket such that it can be rotated about its longitudinal axis. The pin and the two bars form a cage for enclosing steel ball 28. The spacing between the pins and the bars is such that the ball cannot be removed except by removal of one of the pins.

Pin 20 is the only pin removable from the cap and the base.

Figure 3:
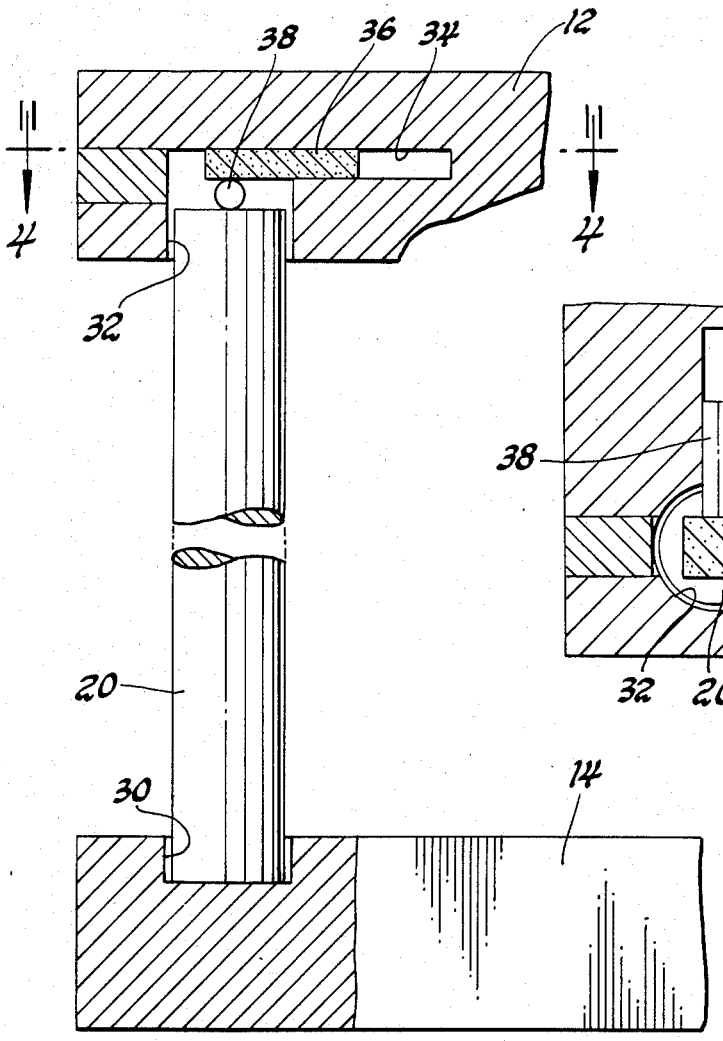
FIG. 3 is an enlarged view showing the magnet means.
Figure 4:
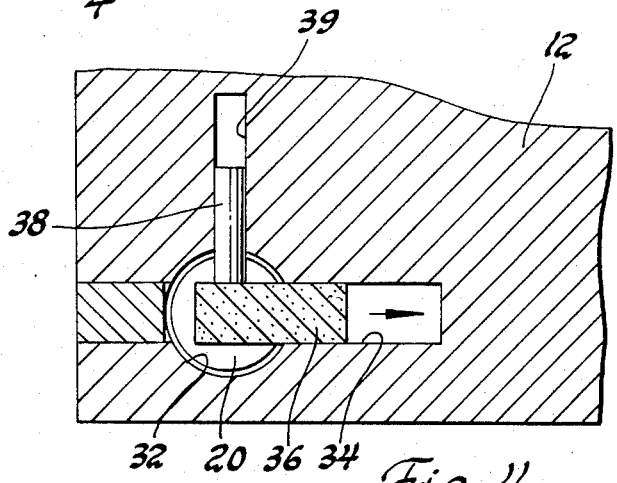
FIG. 4 is a view as seen along the lines 4—4 of FIG. 3.

Referring to FIGS. 3 and 4, the lower end of pin 20 is mounted in socket 30 in base 14. The cap has opening 32 receiving the upper end of pin 24. Opening 32 is sufficiently deep that when pin 20 is raised to the top of opening 32, the lower end of the pin clears socket 30 so that the pin can be pivoted about the upper opening and then removed from the cap.

The cap has an elongated opening 34 at right angles to the pin. Magnetic member 36 is slideably disposed in opening 34.

Latch 38 is mounted in opening 39 for slideable movement between a locking position, illustrated in FIG. 4, in which the latch prevents pin 20 from being moved toward the top of opening 32, and a release position, in which the latch is removed from opening 32 to permit pin 20 to be raised to the top of opening 32. Magnetic member 36 engages the latch in its locking position to prevent it from sliding toward its release position unless the cage is tapped to cause the magnet to move toward the closed end of opening 34. A second impact on the cap will cause the latch to move to its release position.

The mass of the latch and the magnetic member are chosen such that it requires a deliberate but light tapping motion on the cap in a direction parallel to elongated openings 34 and 39 to move the latch and the magnetic member. A tap in any other direction will not cause relative motion between the latch and the cap. It is extremely difficult to release the pin by one unaware of the release procedure.

Having described my invention, I claim:

1. An amusement device comprising:

a base;

a cap;

a ball disposed between the base and the cap;

structure means mounted between the base and the cap and connected thereto to prevent the cap from being moved away from the base and to prevent removal of the ball from its position between the cap and the base, said structure means including a pin, the base having an opening for one end of the pin, the cap having an opening for the opposite end of the pin;

the openings in the cap and the base being aligned one with the other such that the pin can be removed by moving one end of the pin toward the opening in the cap until the opposite end of the pin clears the base opening;

a latch member disposed in the cap opening and engageable with the pin to prevent its motion toward the cap, the latch member being movable between a locking position in which it prevents motion of the pin toward the cap, and a release position in which the latch member is not disposed in the path of motion of the pin; and magnet means disposed in the cap to engage the latch member in said locking position, the magnet means being movable to a position in which it releases the latch member for movement toward said release position.

2. A combination as defined in claim 1, in which the structure means cooporates with the cap and the base to form a cage for the ball.

3. A combination as defined in claim 2, in which the cap and the base are each four-sided members cooperating with the pins to form a cage for the ball.

4. A combination as defined in claim 1, in which the latch member is movable to said release position in response to an impact applied to the cap.

5. A combination as defined in claim 1, in which the structure means comprises four pins mounted between the cap and the base about the ball, each pin being rotatable about its respective longitudinal axis.

6. A combination as defined in claim 5, including a pair of pins each having their ends attached to the cap and the base to prevent motion of the cap away from the base.

7. A combination as defined in claim 1, in which the magnet member is disengageable with the latch member in response to an impact applied to the cap.

* * * * *